United States Patent [19]

Weisz

[11] 4,235,180

[45] Nov. 25, 1980

[54] COMPACT FEED BAR

[75] Inventor: William Weisz, Tenafly, N.J.

[73] Assignee: The Singer Company, Stamford, Conn.

[21] Appl. No.: 122,773

[22] Filed: Feb. 19, 1980

[51] Int. Cl.[3] ..... D05B 27/02

[52] U.S. Cl. ..... 112/323; 112/220

[58] Field of Search ..... 112/323, 314, 303, 312, 112/220

[56] References Cited

U.S. PATENT DOCUMENTS

| | | | |
|---|---|---|---|
| 3,527,183 | 9/1970 | Szostak | 112/323 |
| 3,534,696 | 10/1970 | Willenbacher et al. | 112/323 |
| 4,018,172 | 4/1977 | Kettener | 112/323 |

*Primary Examiner*—H. Hampton Hunter

*Attorney, Agent, or Firm*—Robert E. Smith; Edward L. Bell

[57] ABSTRACT

A sewing machine work feed mechanism with guide means for tilt free motion of the feed dog in a linear path, the feed mechanism utilizing a fabricated sheet metal feed bar, centrally pivoted, and of a length from the pivot to one end of at least 10 times the maximum feed stroke.

4 Claims, 4 Drawing Figures

COMPACT FEED BAR

BACKGROUND OF THE INVENTION

This invention is in the field of sewing machines, more particularly, it relates to a compact feed system for a sewing machine.

Over a period of years, the household sewing machine has become increasingly more complex and, correspondingly, more capable. The earliest family sewing machines were primarily straight stitch machines, with the ability to perform zigzag stitching coming at a much later time. This ability to produce zigzag stitches was accomplished, in the main, by the use of a cam, and the later of addition of additional cams to produce additional needle patterns was a natural outgrowth of this ability to produce zigzag stitches. With the ability to obtain a blind stitch in a sewing machine, there came the further development of cylinder bed sewing machines, or sewing machines having a flat bed convertible to a cylinder bed, which required compact feed devices to fit into the cylinder bed.

In time, in addition to being able to vary needle position, the sewing machines were also able to depart from a steady feed condition and control feed by cams. Thus, the present day sewing machine is able to vary needle position and to vary feed in order to obtain extremely complicated stitch patterns including those of human or animal figures. At about this same time, or shortly thereafter, the more powerful SCR drive motors were incorporated into sewing machines so as to provide greater operator control over the stitching by control of speed and permit higher speeds to be attained. However, many of these complicated stitch patterns could only be performed at low speeds due to the high inertia of the feed systems and the high feedback of forces from the feed dog to the stitch regulator which caused stitch variations. Still another development in sewing machines made the higher feedback forces more critical, and required the development of another device to lock the feed regulator shaft during the feed portion of the feed cycle in order to prevent shifting of the feed regulator. Thus, in an electronically controlled sewing machine, the linear motor was found to be ideal to shift the feed regulator but offered little resistance to feedback forces from the feed dog.

What is required is a compact feed system having low inertia and which will enable error free implementation of the complicated cam control feed patterns at any sewing machine speed while also providing for low feedback of the feed dog reaction to the stitch regulator. The device which satisfies these requirements, to be useful, must be in compact form to enable its use in a cylinder bed of a sewing machine.

SUMMARY OF THE INVENTION

The above requirements are obtained in a work feed device in which the work feed dog is guided in its vertical and horizontal motion and urged into this motion by a centrally pivoted, short, fabricated feed bar of light construction but having a high moment of inertia in the direction of motion. Feed motion is derived from an oscillating lever which is connected to one end of one of a pair of overcenter links which are connected together on the other end for regulation purposes. The free end of the second overcenter link is connected to the feed bar so as to transmit motion from the oscillating lever to the feed bar. By varying the position of the end of the overcenter links which are connected together, the amount of feed motion transmitted to the feed bar may be varied. A connecting link extends between the commonly connected end of the overcenter links and bell crank interposer between a transfer link connection to a linear motor. The connecting link extends substantially at right angles to the overcenter links, and substantially parallel to the feed bar, so that the feedback motion derived from the feed dog and transmitted through the feedbar will have a minimum effect on displacing the linear motor.

DESCRIPTION OF THE DRAWINGS

In order that the invention may be more fully understood, it will now be described, by way of example, with reference to the accompanying drawings in which:

Referring now to FIG. 1, there is shown a portion 10 of the cylinder bed of a sewing machine in cross section in which is supported the compact feed system of this invention. A feed and hook drive shaft 12 is supported in bearings 14 in the cylinder bed portion 10 of the sewing machine, the bearings being formed with a generally spherical extremity and retained by socket clamps 15 which are fastened to the cylinder bed portion by screws 16. On one end of the drive shaft 12 there is supported a bevel gear 18 which is in mesh with a corresponding bevel gear 19 shown in phantom as is the looptaker 20 to which it is attached. The opposite end of the drive shaft 12 carries a pulley 22 which may be connected by means of a timing belt 23 to a drive motor (not shown) of the sewing machine.

Figures 1, 2, 3:
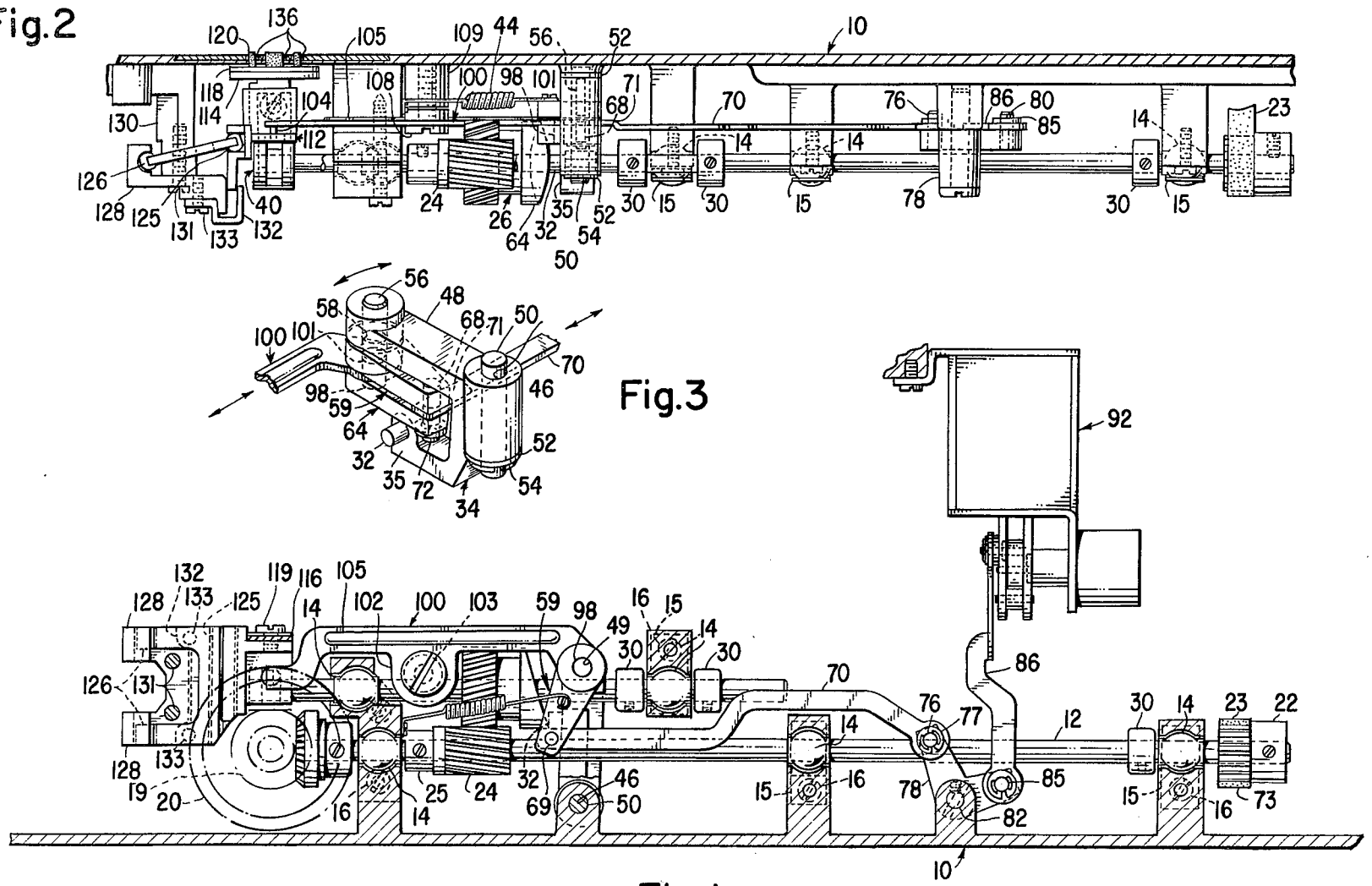
FIG. 1 is a top plan view of the mechanism for actuating the feed dog as supported in the cylinder bed of a sewing machine.
FIG. 2 is an elevation of the work feed mechanism shown in FIG. 1.
FIG. 3 is an isometric view of some of the driving and regulating components of the feed system depicted in FIGS. 1 and 2; and, FIG. 4 is an exploded isometric view of the parts of the feed system shown in FIGS. 1 and 2.

Spaced inwardly from the bevel gear 18 on the drive shaft 12, is a helical gear 24 whose position on the shaft may be fixed by set screw 25. The helical gear 24 is in mesh with a larger helical gear and cam combination 26 which is supported on a feed shaft 28, itself carried by bearings 14 attached to the cylinder bed portion 10 in the same fashion as the bearing supporting the drive shaft 12. It should be noted that the hook drive shaft 12 and the feed shaft 28 retain their endwise position by means of collars 30 affixed to the shafts adjacent some of the bearings 14. The helical gear and face cam combination 26 is fashioned on one end thereof with a face cam 27, which face cam abuts upon pin 32 carried upon the lower arm 35 of an oscillating lever 34 (See also FIGS. 3 and 4). On the end of thd feed shaft 28 adjacent the helical gear and face cam combination 26, there is supported a feed lift cam 40, clearly visible in FIG. 4, the operation of which will be more fully explained below.

Figure 4:
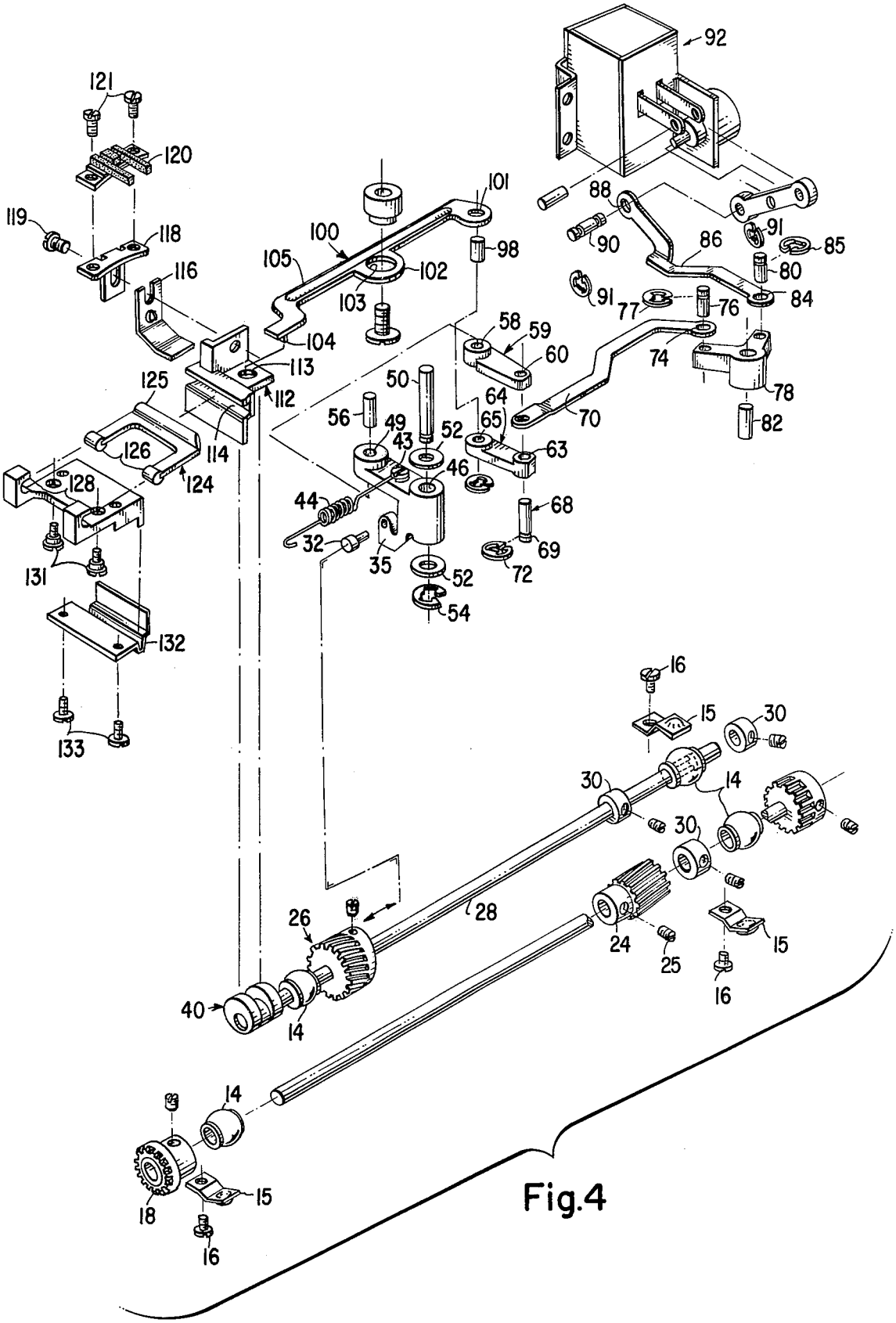

Returning now to the oscillating lever 34, in FIGS. 3 and 4, an aperture 46 is provided thereon which is received on a post 50 affixed to the cylinder bed portion 10 of the sewing machine. Thus, the oscillating lever 34 pivots upon the post 50 between washers 52 and is retained on the post by retaining ring 54 captured upon groove 51 at the bottom of the post. The axis of the aperture 46 of the oscillating lever 34, and of the post 50 are transverse to the feed shaft 28. The oscillating lever 34 is fashioned with an upper arm 48 extending in the same direction as the lower arm 35, the upper arm terminating in a bore 49 having an axis parallel to that of the post 50. A screw 43 is threadedly received in the upper arm 48 and captures one end of extension spring 44, the other end of which is connected to a boss of the cylinder bed portion 10 so as to bias the pin 32 carried by the oscillating lever 34 always against the face cam 27 for oscillation thereby. A pin 56 is captured in the bore 49 and extends into a hole 58 in one end of a first overcenter link 59 having a hole 60 in the other end thereof. A second overcenter link 64 is situated beneath the first overcenter link 59, the second link being fashioned with a hole 63 on one end thereof axially aligned with the hole 60 on the first overcenter link. The second overcenter link 64 is further fashioned with a hole 65 on the other end thereof. A pintal 68 extends through the hold 63 in the second overcenter link 64, an aperture 71 on one end of a connecting link 70, and is a pressed fit into the hole 60 on the end of the first overcenter link 59. A retaining ring 72 seats into a groove 69 on the end of the pintal 68 so as to retain the connecting links 70 and the second overcenter link 64 on the pintal. The other end of the connecting link 70 is also formed with an aperture 74, which aperture fits over a stud 76 press fit into the end of one arm of a bell crank 78. A retaining ring 77 retains the connecting link 70 on the stud 76. The bell crank 78 pivots on a rod 82 affixed in the cylinder bed portion 10 of the sewing machine. The second arm of the bell crank 78 is also fashioned at the end thereof with a stud 80 which is encircled by an aperture 84 on one end of a transfer link 86 and there retained by retaining ring 85. The other end of the transfer link 86 is also fashioned with an aperture 88 which encircles a stub shaft 90 carried by a force transmitting lever of a linear motor 92 such as is described in U.S. Pat. No. 4,016,441, which issued on Apr. 5, 1977 to the same assignee as the instant application and which is hereby incorporated by reference herein. The linear motor 92 is responsive to electronic information derived from a solid state memory and transferred to the linear motor by way of a servo amplifier. Equally effective however, would be a combination of a linkage with a mechanical cam for supplying the feed information. The transfer link 86 is retained on the stub shaft 90, along with the force transmitting lever of the linear motor 92, by retaining rings 91.

Referring once again to the overcenter link 64, a stub shaft 98 is slidably accomodated in the hole 65 thereof and is a press fit or otherwise fastened to a hole 101 in one end of a feed bar 100. Approximately in the center of the feed bar 100 there is an enlargement 102 within which there is a second hole 103. A shouldered collar 107 is provided having a reduced section which extends into this hole 103 so as to permit free movement of the feed bar 100, and a screw 108 extends through the collar 107 into a tapped opening in a boss 109 in the cylinder bed portion 10 of the sewing machine. Thus, the feed bar 100 is able to pivot freely about the shoulder on the collar 107 under the urgings of the overcenter links 59, 64 as urged by the oscillating lever 34. The end of the feed bar 100 opposite the hole 101 is formed with a downwardly extending tang 104, for a purpose which will be explained below. Preferably, the feed bar 100 is fabricated from sheet metal in order to attain a light weight construction which may be strengthened and made yet more rigid in the preferred direction by forming with a concavity 105 extending along the length of the feed bar.

The tang 104 fits into an opening 113 in a feed dog linear feeding guide 112. A bottom surface of the linear guide 112 rests upon the feed lift cam 40 and is retained contiguous thereto by means of a spring 116. The spring 116 is retained in position by being trapped between a feed dog holder 118 and the linear feeding guide 112 as retained by screw 119. A feed dog 120 is retained on the feed dog holder 118 by a pair of screws 121. The linear feeding guide 112 is fashioned with a groove 114 extending in the feeding direction, which groove receives a first end 125 of a feed dog level guide 124, which end has a circular cross section precisely accommodated within the groove. A second end 126 of the feed dog level guide 124 is also of circular cross section and is accommodated in circular grooves 129 provided therefor in feed dog level guide support 128. Bosses 130 are provided on the cylinder bed portion 10 of the sewing machine to which the level guide support 128 may be attached by means of screws 131. A feed guide support 132 is fastened to the level guide support 128 by screws 133, and edge of the level guide support and the feed guide support receiving the bottom edge 115 of the linear feeding guide 112 so as to constrain motion of the feeding guide in one direction. Thus, the feed dog level guide 124 insures that the top surface of the feed dog 121 will always remain in parallel planes, while the feed guide support 132 together with the feed dog level guide support 128 insures that the feed dog will have the limbs thereof moved in a plane within slots 137 of the throat plate 136 supported in the cylinder bed 10 of the sewing machine.

In operation, the oscillating lever 34 is urged by the face cam 27 in oscillating motion. Where the pintle 68 joining the overcenter links 59, 64 is located on the line extending between the post 50 and the hole 101 in the feed bar 100, no motion is transferred from the oscillating lever 34 to the feed bar, i.e., zero feed. If the pintle is shifted by the connecting link 70 to one or the other side of the aforementioned line, motion of the oscillating link will cause motion of the pintle 68, and the stub shaft 98, in a back and forth direction normal to the feed bar 100, the stub shaft thereby moving the feed bar. Shifting the pintle to opposite sides of the aforementioned line changes the timing of the motion so as to change direction of the feed motion when the feed dog 120 is urged to an elevated position by the feed lift cam 40. Feedback force from the feed dog 120 to the feed bar 100 will not be transferred to the connecting link 70 when the pintle 68 is located on the aforementioned line but will instead be absorbed internally as stress in the feed bar 100 and overcenter links 59,64. Where the pintle 68 is not located on the aforementioned line, a portion of this feedback force is still absorbed in the feed bar 100 and overcenter links 59, 64, decreasing from fully absorbed on the line.

By utilizing a short, centrally pivoted, feed bar 100 which is preferably fabricated from sheet metal and rigid in the direction of feed, extremely low inertia can be obtained which permits excursions from one extreme to the other of feed with minimum deflection at relatively high speeds. By restricting the feed dog 118 to motion in a linear path, arcuate motion of the feed bar 100 is of less concern, and therefor, the feed bar may be made a great deal shorter, thereby further reducing the stress level in the feed bar to a small fraction of that previously encountered. Thus, complex patterns utilizing feed controlled cams requiring frequent reversal of feed from one extreme to the other can be accommodated at considerably higher speed. As a practical matter, however, the feed bar 100 should have a length from its pivot to the point of connection to the linear feeding guide 112 of at least 10 times the maximum feed stroke so as to retain a degree of linearity over the entire feeding range to reduce the need to compensate therefor in the information retaining device such as a cam or solid state memory.

Additionally, by regulating the feed system by the use of the overcenter links 59, 64 only a component of the feedback force from the feed dog 120 is transferred to the linear motor 92, where as in the prior art device depicted in the U.S. Pat. No. 3,527,183, the feedback force was transferred directly back to the linear motor.

I claim:

1. A work feed mechanism for a sewing machine having a work supporting bed, and a throat plate carried on said bed and formed with feed dog accommodating slot defining a direction of work feed transversely across said bed, said work feed mechanism comprising:

a feed bar pivotally supported substantially centrally thereof in said bed for pivotable motion in a plane, said feed bar extending substantially perpendicular to said feed dog accommodating slot in said throat plate;

a feed dog;

means for accommodating motion of said feed dog in a linear path;

means for connecting said feed dog to a first end of said feed bar;

means for driving the second end of said feed bar a selectable amount for selectable motion of said feed dog; and means for selecting the amount of feed motion over a range from a maximum feed stroke down at least to a minimum feed stroke.

2. A work feed mechanism as claimed in claim 1 wherein said feed bar is of a length between said first end and the substantially central pivot thereof at least 10 times the length of said maximum feed stroke.

3. A work feed mechanism as claimed in claim 2 further comprising means for elevating and lowering said feed dog to a work feeding position and a feed dog return position, respectively, independently of said feed bar.

4. A work feed mechanism as claimed in claim 3 wherein said driving means includes overcenter links having first ends connected together with a second end of one connected to said second end of said feed bar and a second end of the other connected to an oscillating drive member, said overcenter links extending at substantially right angles to said feed bar; and wherein said selecting means includes a connecting link extending from said first ends of said overcenter links substantially parallel to said feed bar, whereby only a component of force feedback from said feed bar is transferred to said connecting link.

* * * * *